US009431734B2

(12) United States Patent
Guo et al.

(10) Patent No.: US 9,431,734 B2
(45) Date of Patent: Aug. 30, 2016

(54) RECEPTACLE CONNECTOR CONNECTED TO A PRINTED CIRCUIT BOARD

(71) Applicant: HON HAI PRECISION INDUSTRY CO., LTD., New Taipei (TW)

(72) Inventors: Jing-Jie Guo, Kunshan (CN); Wen-Zhang Lin, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/464,722

(22) Filed: Aug. 21, 2014

(65) Prior Publication Data

US 2015/0056858 A1 Feb. 26, 2015

(30) Foreign Application Priority Data

Aug. 21, 2013 (CN) ..... 2013 2 05115074 U

(51) Int. Cl.

| | |
|---|---|
| ***H01R 12/72*** | (2011.01) |
| ***H01R 13/405*** | (2006.01) |
| ***H01R 13/6594*** | (2011.01) |
| *H01R 12/71* | (2011.01) |
| *H01R 12/77* | (2011.01) |
| *H01R 12/70* | (2011.01) |
| *H01R 13/6581* | (2011.01) |
| *H01R 12/50* | (2011.01) |
| *H01R 43/18* | (2006.01) |
| *H01R 43/24* | (2006.01) |

(52) U.S. Cl.

CPC ..... *H01R 12/722* (2013.01); *H01R 13/405* (2013.01); *H01R 13/6594* (2013.01); *H01R 12/707* (2013.01); *H01R 12/7082* (2013.01); *H01R 12/716* (2013.01); *H01R 12/724* (2013.01); *H01R 12/775* (2013.01); *H01R 13/6581* (2013.01); *H01R 23/6873* (2013.01); *H01R 43/18* (2013.01); *H01R 43/24* (2013.01)

(58) Field of Classification Search

CPC ..... H01R 23/6873; H01R 13/6594; H01R 12/724; H01R 12/716; H01R 13/6581; H01R 12/707; H01R 12/708; H01R 12/722; H01R 12/775

USPC ..... 439/607.35, 607.4

See application file for complete search history.

(56) References Cited

U.S. PATENT DOCUMENTS 8,808,030 B2 * 8/2014 Gao ..... H01R 13/6271 439/607.4

2014/0315439 A1 * 10/2014 Zhang ..... H01R 13/516 439/626

FOREIGN PATENT DOCUMENTS

| | | |
|---|---|---|
| CN | 202585914 | 12/2012 |
| TW | M429211 | 5/2012 |

* cited by examiner

*Primary Examiner* — Abdullah Riyami
*Assistant Examiner* — Justin Kratt
(74) *Attorney, Agent, or Firm* — Wei Te Chung; Ming Chieh Chang

(57) ABSTRACT

A receptacle connector (100) includes an insulative housing (1), a number of contacts (2) retained in the insulative housing, a metal shield (3) covering the insulative housing, a metal plate (4) assembled to the metal shield along a vertical direction perpendicular to the mating direction, and an insulative cover (5) fully molded over the metal shield and partly molded over the metal plate. The metal plate defines a pair of closed slits (412) behind a rear face of the insulative housing. The insulative cover terminates at the closed slits in a mating direction along which a mating plug connector is inserted.

18 Claims, 7 Drawing Sheets

RECEPTACLE CONNECTOR CONNECTED TO A PRINTED CIRCUIT BOARD

BACKGROUND OF THE INVENTION

1. Field of the Invention

The present invention relates generally to a receptacle connector, and more particularly to a receptacle connector having a neat appearance for successfully being connected to a printed circuit board.

2. Description of Related Arts

Taiwan Utility Pat. No. M429211 issued to Cheng Uei on 2012 May 11 discloses a receptacle connector comprising an insulative housing, a plurality of contacts retained in the insulative housing, a metal shield covering the insulative housing for defining a space to receive a mating plug connector, and an insulative cover molded outside of the metal shield. The insulative housing has a base portion and a tongue portion extending forwardly from the base portion. The contacts have a plurality of contacting portions for connecting with the plug connector, a plurality of soldering portions for soldering on a printed circuit board, and a plurality of connection portions connecting between the soldering portions and the contacting portions. The metal shield comprises a case portion surrounding the insulative housing and a pair of rear board-locking portions extending laterally, rearwardly from the case portion for mounting on a printed circuit board. However, insluative material properly flows along the rear board-locking portions towards the printed circuit board during a molding process of the insulative cover. Therefore, the insulative cover has rough edges to damage to a neat appearance which does not meet requirement of customers. Furthermore, the redundant insluative material on the rear board-locking portions obstacles the rear board-locking portions from securing on the printed circuit board.

A receptacle connector having a neat appearance for successfully being connected to a printed circuit board is desired.

SUMMARY OF THE INVENTION

Accordingly, an object of the present invention is to provide a receptacle connector having a neat appearance for successfully being connected to a printed circuit board.

To achieve the above object, a receptacle connector includes an insulative housing, a number of contacts retained in the insulative housing, a metal shield covering the insulative housing, a metal plate assembled to the metal shield along a vertical direction perpendicular to the mating direction, and an insulative cover fully molded over the metal shield and partly molded over the metal plate. The metal plate defines a pair of closed slits behind a rear face of the insulative housing. The insulative cover terminates at the closed slits in a mating direction along which a mating plug connector is inserted.

Other objects, advantages and novel features of the invention will become more apparent from the following detailed description when taken in conjunction with the accompanying drawings.

DETAILED DESCRIPTION OF THE PREFERRED EMBODIMENT

Figure 1:
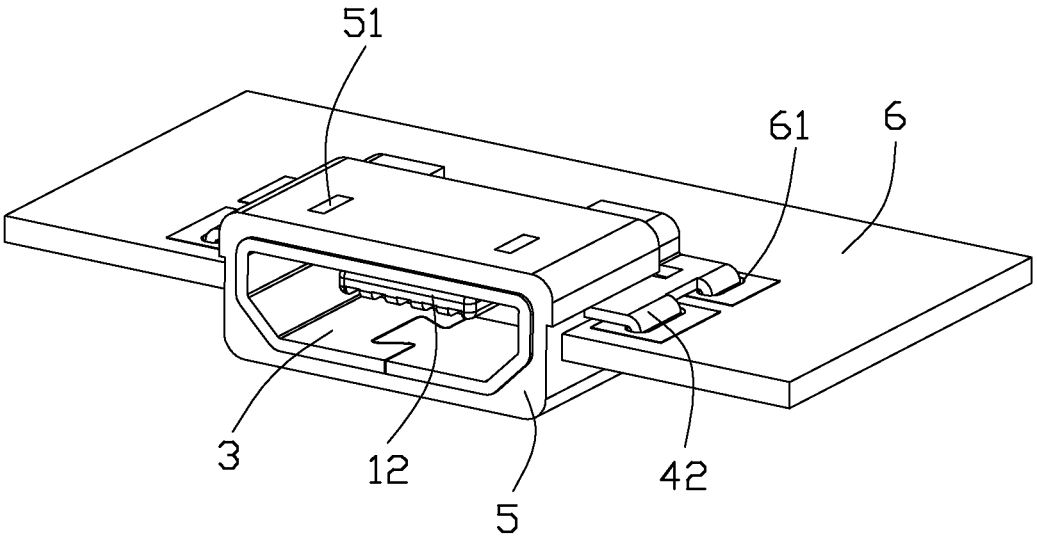
FIG. 1 is a perspective, assembled view of a receptacle connector on a printed circuit board constructed in accordance with the present invention.
Figure 2:
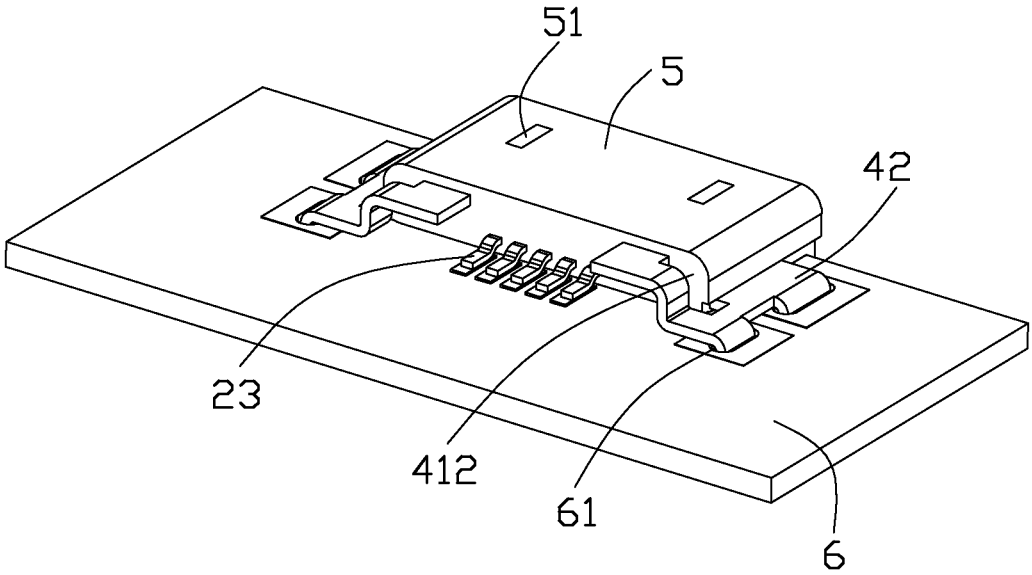
FIG. 2 is similar to FIG. 1, but taken from a different view.
Figure 3:
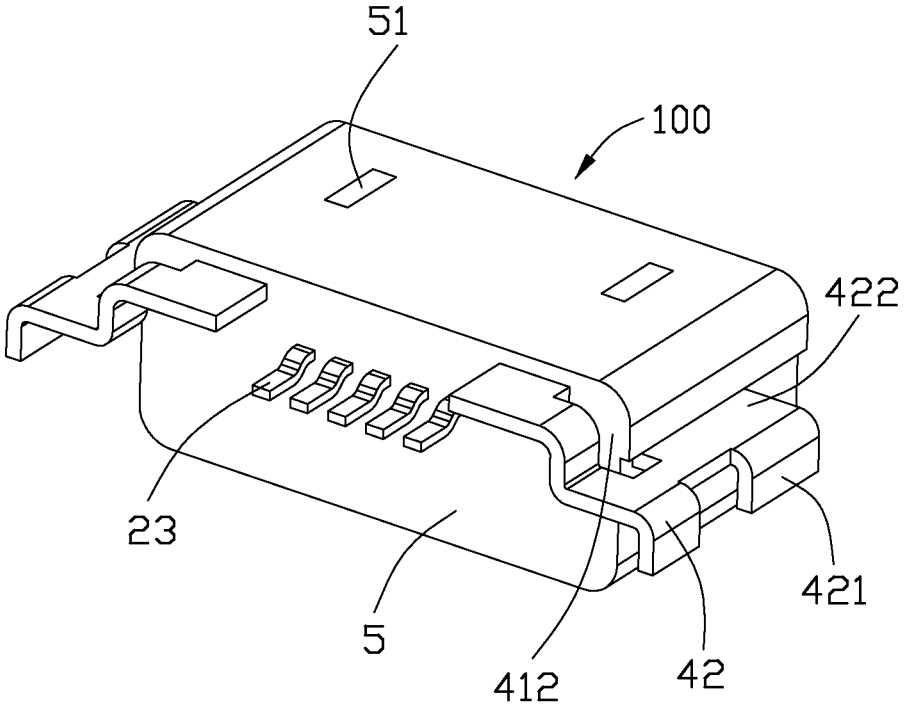
FIG. 3 is a perspective, assembled view of the receptacle connector of FIG. 1.
Figure 4:
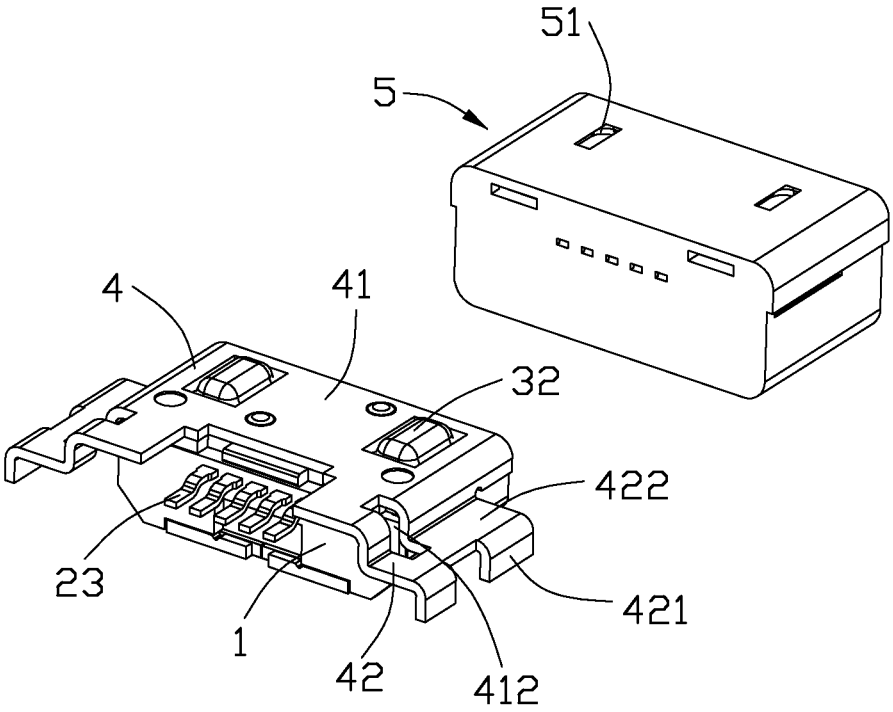
FIG. 4 is a perspective, partly exploded view of the receptacle connector.
Figure 5:
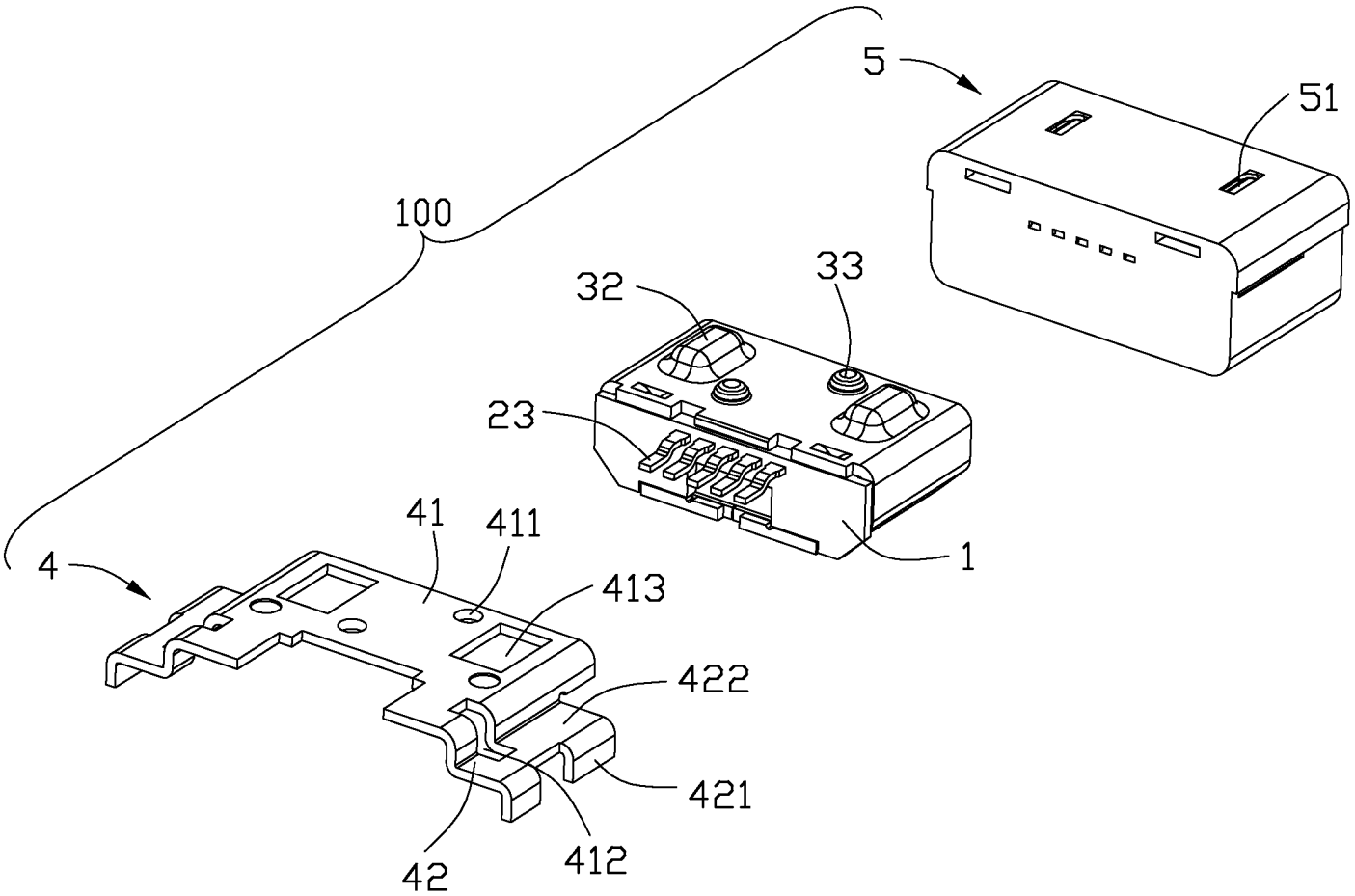
FIG. 5 is a perspective, further exploded view of the receptacle connector with respect to FIG. 4.

Reference will now be made in detail to the preferred embodiment of the present invention.

Referring to FIGS. 1-7, a receptacle connector 100 of the present invention used for receiving a mating plug connector (not shown) along a mating direction, comprises an insulative housing 1, a plurality of contacts 2 retained in the insulative housing 1, a metal shield 3 covering the insulative housing 1 to form a mating port for defining a space 30 to receive the mating plug connector, a metal plate 4 assembled to the metal shield 3 along a vertical direction perpendicular to the mating direction, and an insulative cover 5 molded over the metal shield 3 and the metal plate 4.

Figure 6:
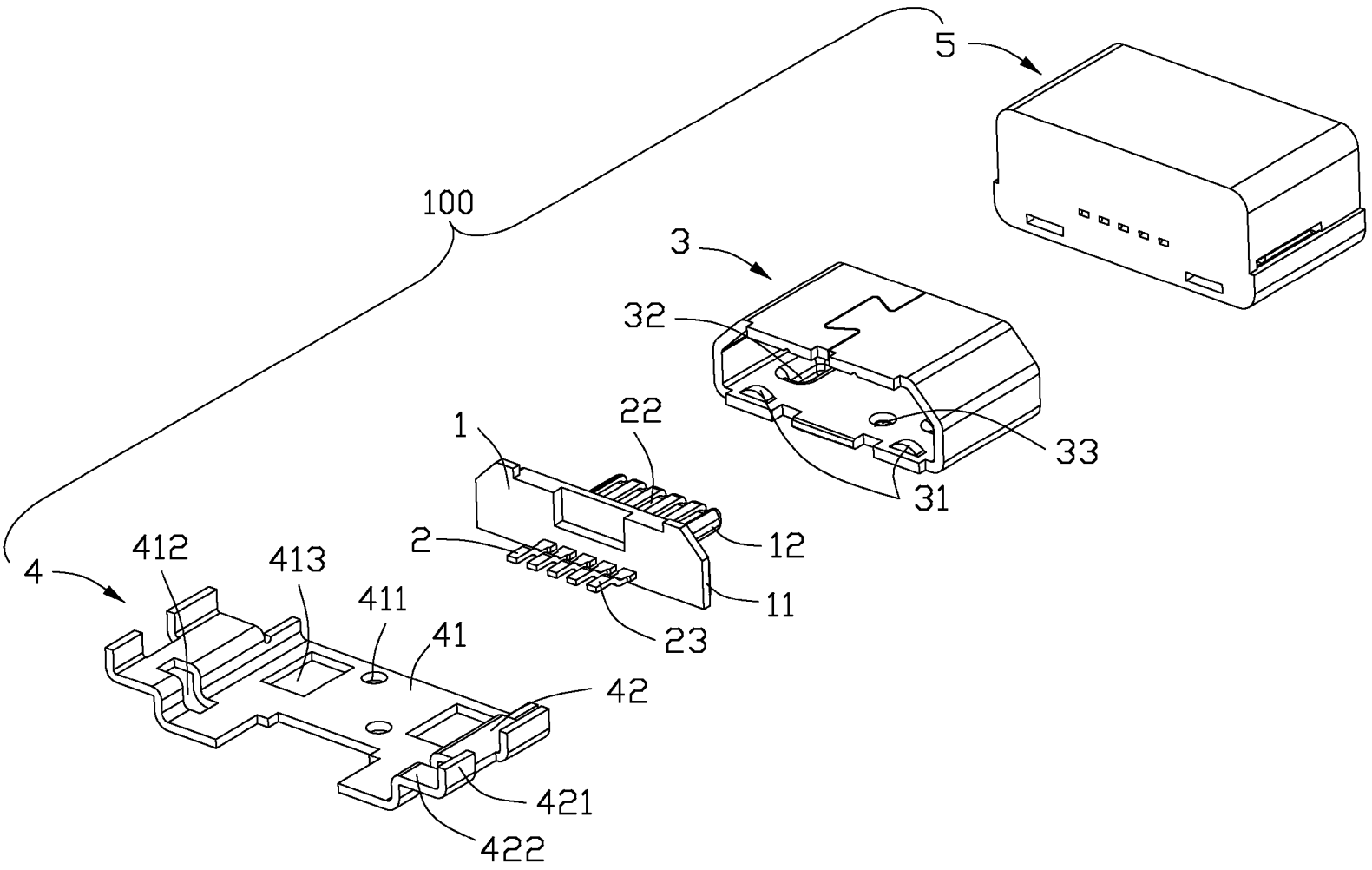
FIG. 6 is a a perspective, fully exploded view of the receptacle connector.
Figure 7:
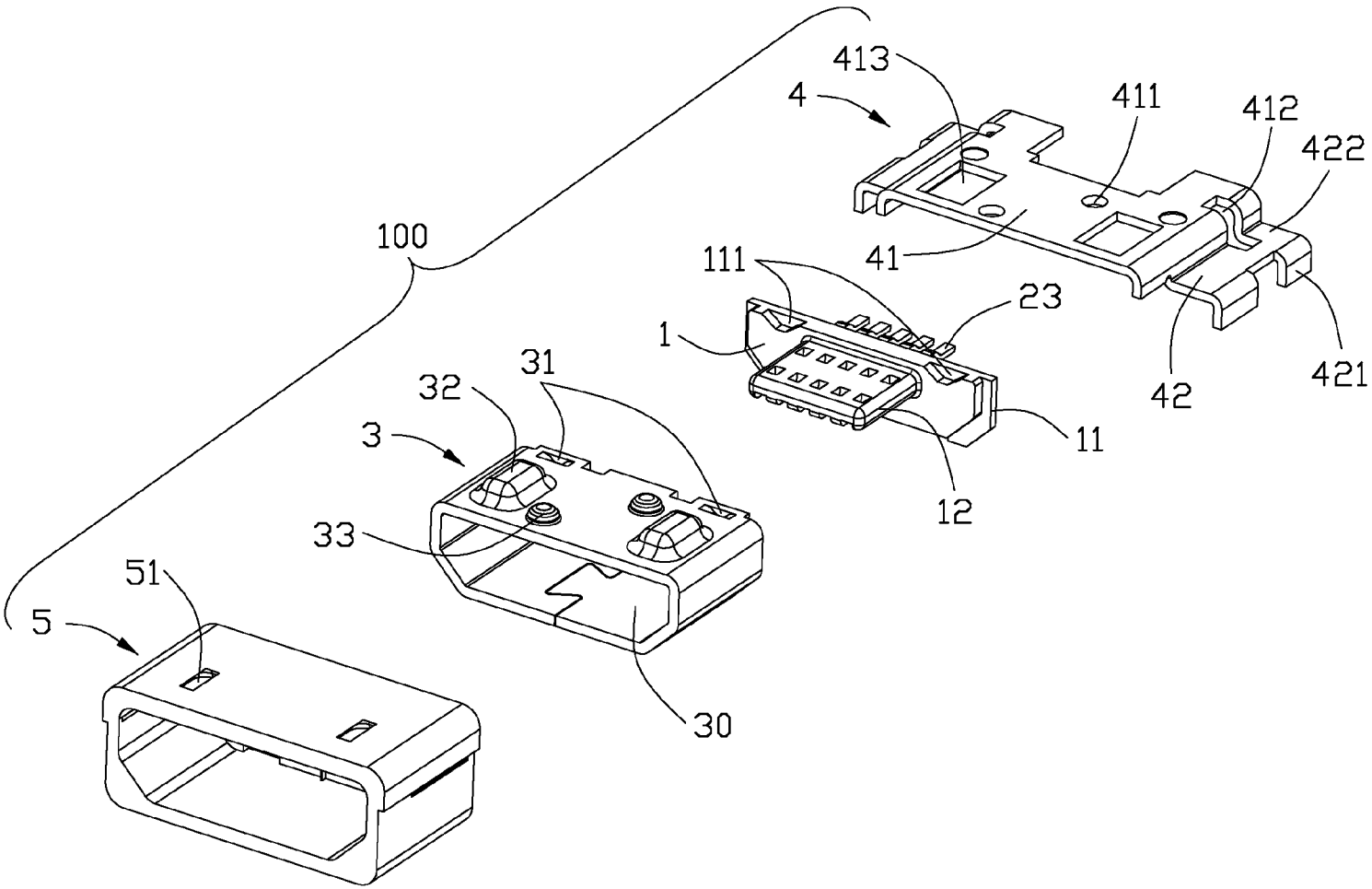
FIG. 7 is similar to FIG. 6, but taken from a different view.

Referring to FIGS. 6 and 7, the insulative housing 1 comprises a base portion 11 and a tongue portion 12 extending forwardly from the base portion 11. The base portion 11 defines a plurality of cutouts 111 from an upper face and a lower face thereof. The mating port comprises the space 30 and the tongue portion 12.

Referring to FIGS. 6 and 7, the contacts 2 are insert-molded in the insulative housing 1. The contacts 2 comprise a plurality of retaining portions (not shown) retained in the base portion 11 of the insulative housing 1, a plurality of contacting portions 22 extending forwardly from the retaining portions and beyond the tongue portion 12, and a plurality of rear portions 23 extending rearwardly from the retaining portion and outside of the insulative housing 1 for soldering on a printed circuit board (not shown).

Referring to FIGS. 6 and 7, the metal shield 3 is a case portion assembled on the insulative housing 1. The metal shield 3 comprises a plurality of protrusions 31 received in the cutouts 111 for securing the metal shield 3 with the insulative housing 1. The metal shield 3 defines a pair of heaves 32 protruding from a top face of the metal shield 3. The heaves 32 are secured with corresponding portions of the plug connector when the plug connector is inserted in the space 30. The heaves 32 are higher than the top face of the metal shield 3 for facilitating molding of the insulative cover 5. The metal shield 3 forms a plurality of posts 33 on the top face thereof for securing with the metal plate 4.

Referring to FIGS. 3-7, the metal plate 4 comprises a main portion 41 and a pair of board-locking portions 42 extending laterally and rearwardly from the main portion 41. The main portion 41 defines a pair of openings 413 receiving the heaves 32 for preliminarily orienting the metal plate 4 on the metal shield 3. The main portion 41 further defines a plurality of apertures 411 corresponding receiving the posts 33 for firmly securing the metal plate 4 on the metal shield 3. The metal plate 4 defines a pair of closed slits 412 behind a rear face of the insulative housing 1. The closed slits 412 extend from the main portion 41 to the corresponding board-locking portions 42 along a transverse direction perpendicular to both the mating direction and the vertical direction. Each slit 412 is used for receiving a mould when molding of the insulative cover 5. The moulds are received in the closed slits 412 for preventing redundant insluative material from flowing on the board-locking portions 42. Therefore, the insulative cover 5 does not have rough edges, i.e., the insulative cover 5 has a neat appearance facilitating soldering the board-locking portions 42 of the metal plate 4 on the printed circuit board. Each board-locking portion 42 comprises a horizontal portion 422 positioned at a middle level of the metal shield 3 and a vertical portion 421 bent vertically from edges of the horizontal portion 422. Therefore, the receptacle connector 100 sinks below the printed circuit board for saving space above the printed circuit board.

Referring to FIGS. 1-7, the insulative cover 5 is fully molded over the metal shield 3 and partly molded over the metal plate 4. The insulative cover 5 defines a plurality of notches 51 on both an upper surface and a rear surface thereof. The notches 51 are formed by withdrawing a clamping tool (not shown) which orients the insulative housing 1, the metal shield 3, and the metal plate 4. After molding of the insulative cover 1, the notches 51 are filled with glue material for waterproof purpose. The main portion 41 of the metal plate 4 is retained in the insulative cover 5. The board-locking portions 42 and the closed slits 412 are exposed out of the insulative cover 5. Namely, the insulative cover 5 terminates at the closed slits 412 along the mating direction.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A receptacle connector, comprising:

an insulative housing;

a plurality of contacts retained in the insulative housing;

a metal shield covering the insulative housing;

a metal plate assembled to the metal shield along a vertical direction perpendicular to the mating direction, the metal plate comprising a main portion and a pair of board-locking portions extending laterally and rearwardly from the main portion for being soldered with a printed circuit board, the metal plate defining a pair of closed slits behind a rear face of the insulative housing; and an insulative cover fully molded over the metal shield and partly molded over the metal plate, terminating at the closed slits in a mating direction along which a mating plug connector is inserted.

2. The receptacle connector as claimed in claim 1, wherein the closed slits extend from the main portion to the corresponding board-locking portions along a transverse direction perpendicular to both the mating direction and the vertical direction.

3. The receptacle connector as claimed in claim 1, wherein the main portion is retained in the insulative cover while the board-locking portions and the closed slits are exposed out of the insulative cover.

4. The receptacle connector as claimed in claim 1, wherein each board-locking portion comprises a horizontal portion positioned at a middle level of the metal shield and a vertical portion bent vertically from edges of the horizontal portion.

5. The receptacle connector as claimed in claim 1, wherein the insulative cover defines a plurality of notches on both an upper surface and a rear surface thereof formed by withdrawing a clamping tool which orients the insulative housing, the metal shield, and the metal plate.

6. The receptacle connector as claimed in claim 5, wherein the notches are filled with glue material after molding of the insulative cover.

7. A receptacle connector assembly comprising:

an insulative housing defining a mating tongue;

a plurality of contacts disposed in the housing via an insert molding process;

a metal shield enclosing the housing to form a mating port in which said mating tongue is exposed;

a metal plate having a top plate preassembled to a top wall of the metal shield and a pair of board-locking portions respectively located on two opposite sides of the top plate for mounting to a printed circuit board; and an outer insulator enclosing said metal shield and said metal plate while exposing the board-locking portions by two lateral sides in a transverse direction; wherein said metal plate extends rearwardly beyond a rear face of the outer insulator with a recess to upwardly expose tails of the contacts which extend rearwardly beyond the rear face.

8. The receptacle connector assembly as claimed in claim 7, wherein the metal shield includes a pair of heaves on the top wall to form a pair of recesses facing the mating port for locking corresponding latches, the top plate forms a pair of openings therein to receive said pair of heaves, respectively, and the outer insulator forms a pair of notches to expose said pair of heaves upwardly and outwardly.

9. The receptacle connector assembly as claimed in claim 7, wherein the rear face of the outer insulator extends beyond an inner edge of the recess.

10. The receptacle connector assembly as claimed in claim 7, wherein each of said board-locking portions forms a step structure with a horizontal section and a vertical section, said horizontal section being coplanar with tails of the contacts.

11. The receptacle connector assembly as claimed in claim 7, wherein the metal shield includes at least one upward post on the top wall, and the top plate includes an aperture to receive said post.

12. The receptacle connector assembly as claimed in claim 11, wherein the top plate and the top wall are preassembled with each other via soldering around said post.

13. The receptacle connector assembly as claimed in claim 7, wherein the metal plate includes at least one slit in which a rear face of the outer insulator is terminated.

14. The receptacle connector assembly as claimed in claim 13, wherein the metal plate defines a step structure around the slit.

15. The receptacle connector assembly as claimed in claim 13, wherein the board-locking portion is roughly aligned with the slit in said transverse direction.

16. A receptacle connector assembly comprising:

an insulative housing defining a mating tongue;

a plurality of contacts disposed in the housing via an insert molding process;

a metal shield enclosing the housing to form a mating port in which said mating tongue is exposed;

a metal plate having a top plate preassembled to a top wall of the metal shield and a pair of board-locking portions respectively located on two opposite sides of the top plate for mounting to a printed circuit board; and an outer insulator enclosing said metal shield and said metal plate while exposing the board-locking portions by two lateral sides in a transverse direction; wherein the metal plate includes at least one slit in which a rear face of the outer insulator is terminated.

17. The receptacle connector assembly as claimed in claim 16, wherein the metal plate defines a step structure around the slit.

18. The receptacle connector assembly as claimed in claim 16, wherein the board-locking portion is roughly aligned with the slit in said transverse direction.

* * * * *